United States Patent [19]

Hole

[11] 4,324,398

[45] Apr. 13, 1982

[54] SAFETY APPARATUS FOR BARBELL

[76] Inventor: Robert W. Hole, 78I Woodbine Ave., Toronto, Ontario, Canada, M4E 2J5

[21] Appl. No.: 190,247

[22] Filed: Sep. 24, 1980

[51] Int. Cl.[3] ..... A63B 21/06

[52] U.S. Cl. ..... 272/123

[58] Field of Search ..... 272/118, 117, 143, 144, 272/134, 123; 273/26 E, 26 A, 1.5 A

[56] References Cited

U.S. PATENT DOCUMENTS

| | | | |
|---|---|---|---|
| 1,546,187 | 7/1925 | Bach | 272/118 |
| 3,166,317 | 1/1965 | Tumelson | 273/26 E |
| 4,229,002 | 10/1980 | Masters | 272/143 |
| 4,252,314 | 2/1981 | Ceppo | 272/123 X |
| 4,253,662 | 3/1981 | Podolak | 272/123 |
| 4,256,301 | 3/1981 | Goyette | 272/123 |

*Primary Examiner*—Richard C. Pinkham
*Assistant Examiner*—William R. Browne
*Attorney, Agent, or Firm*—Fetherstonhaugh & Co.

[57] ABSTRACT

A weight lifting apparatus for use in bench press and/or squat lifting exercises having a frame in which a pair of cables are mounted in a guide track with one portion of each cable depending into an exercise station located beneath a boom of the frame and another portion of each cable depends adjacent the upright portion of the frame. Stops are provided on the cable and the frame which interact and serve to limit the extent to which the cable may depend into the exercising station. Mounting clamps are provided at the ends of the cables which depend into the exercising station to which a weight-lifting bar may be secured in a horizontal plane extending therebetween. The stops serve to limit the extent to which the cables may depend into the exercising station so that, in use, the extent to which the weight support bar may be lowered is limited.

2 Claims, 3 Drawing Figures

SAFETY APPARATUS FOR BARBELL

SUMMARY OF THE INVENTION

My invention is a tubular steel frame with a wide base that stands in an upright position. My frame is unique in that a person can exercise with very heavy bench presses and squats in complete safety without the aid of a partner in the privacy of his own home or other appropriate area. The back of the frame is equipped with a safety locking bar that can be adjusted to the correct heighth up or down when doing presses or squats allowing the barbell to descend only as far as the safety locking bar permits. The frame is convenient in the fact that the supporting bars on the back of the frame, the safety locking bar, the springs and weights at the back end of the cables, and the solid steel bars that support the wheels can all be removed thus dividing the frame in half for easy transportation or storage. My frame can be utilized almost anywhere and will save much needed time and money.

BRIEF DESCRIPTION OF THE DRAWINGS

The objects and features of the invention may be understood with reference to the following detailed description of an illustrated embodiment of the invention, taken together with the accompanying drawings in which.

DESCRIPTION OF THE PREFERRED EMBODIMENT

Figure 1:
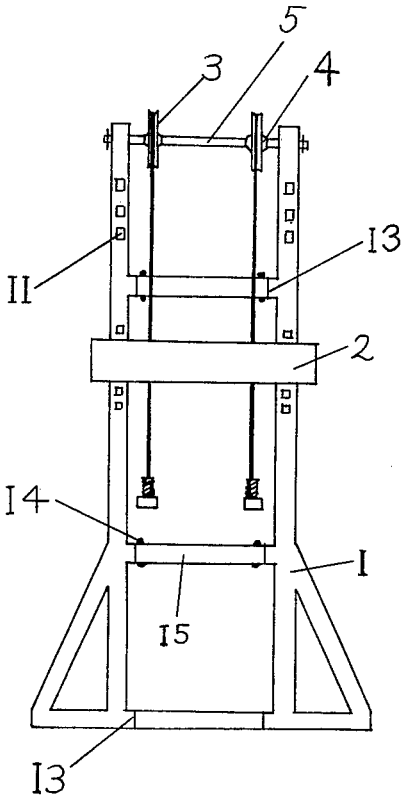
FIG. 1 is a back view of the frame with cables, springs and weights, safety locking bar, supporting bars, solid steel bar, wheels and sleeves all in tact.

Turning now descriptively to the drawings, in which similar reference characters denote similar elements throughout the several views, FIG. 1 shows the frames back I with the safety locking bar 2 in the lower set of locking bar slots II with the plastic coated steel cables 7 passing through the locking bar 2, up and over the back set of wheels 3 which are supported by the solid steel bar 5 and the steel locking sleeves 4. Shown also are the supporting bars I5 the high tensile steel pins I4 and the supporting bar seems I3.

Figure 2:
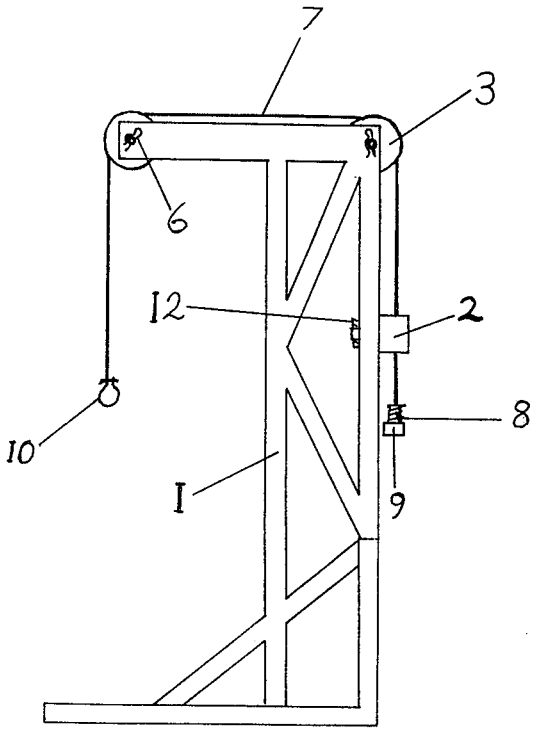
FIG. 2 is a side view of the frame showing weights, springs, safety locking bar, locking pin, cables, wheels and cotter pins and clamp that attaches to the barbell.

FIG. 2 shows a side view of the frame I with the plastic coated steel cable 7 supporting the weight 9 and spring 8, the cable 7 passes through the safety locking bar 2 up and over the back and front wheels 3 and down to the special clamp I0 which attaches to the barbell. Also shown is the cotter pins 6 and the locking pin I2 for the locking bar 2.

Figure 3:
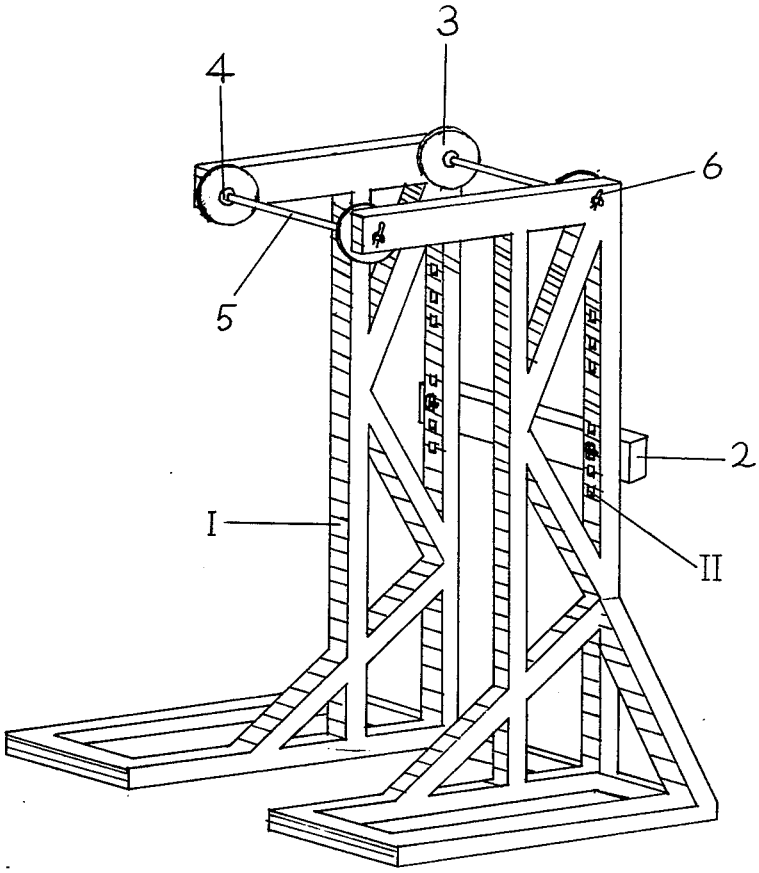
FIG. 3 is a perspective view of the frame illustrating the base, the bracing, wheels, steel bars, cotter pins, safety locking bar and locking bar slots.

FIG. 3 is a perspective view of the frame I viewing the solid steel bars 5 locking sleeves 4 wheels 3 cotter pins 6 safety locking bar 2 and locking bar slots II.

Having described a preferred embodiment of my invention it is understood that various changes can be made without departing from the spirit of my invention, and, I desire to cover by the appended claims all such modifications as fall within the true spirit and scope of my invention.

The embodiments of the invention in which an exclusive property or privilege is claimed are defined as follows:

1. A weight-lifting apparatus for use in bench press and/or squat weight-lifting exercises comprising:

(a) a frame having an upright portion and an overhead boom portion arranged to be located at one side and above an exercising station, respectively, (b) guide means on said upright portion and said boom portion defining a pair of spaced parallel guide tracks, (c) a pair of cables mounted one on each guide track for movement therealong, a first portion of each cable depending vertically from the overhead boom into said exercising station and a second portion of each cable depending proximate the upright portion, (d) mounting means on the first portion of each cable receiving a weight-lifting bar in a horizontal position extending therebetween, (e) first stop means on the second portion of each cable to limit movement of the cables, and second stop means on said upright portion of said frame adapted to engage the first stop means to limit the extent to which said first portion of said cable may be lowered into said exercising station whereby upon release of the bar during exercise use the extent to which it will travel when said weight-lifting bar is released and the extent of travel of the bar, being limited by the interaction of the second stop means and the first stop means.

2. A weight-lifting apparatus as claimed in claim 1 wherein the position of the second stop means is adjustable to permit adjustment of the lowermost position of said mounting means within said exercising station.

* * * * *